US006218094B1

(12) United States Patent
den Zegel et al.

(10) Patent No.: US 6,218,094 B1
(45) Date of Patent: Apr. 17, 2001

(54) LIGHT-SENSITIVE SILVER HALIDE MATERIAL PROVIDING IMPROVED SURFACE CHARACTERISTICS AFTER PROCESSING

(75) Inventors: Marc Van den Zegel, Boortmeerbeek; Hubert Vandenabeele, Mortsel; Eddy Michiels, Lichtaart; Frank Louwet, Diepenbeek, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/407,901

(22) Filed: Sep. 29, 1999

Related U.S. Application Data

(60) Provisional application No. 60/112,066, filed on Dec. 14, 1998.

(30) Foreign Application Priority Data

Oct. 8, 1998 (EP) ..... 98203412

(51) Int. Cl.[7] ..... G03C 1/46; G03C 1/76

(52) U.S. Cl. ..... 430/502; 430/531; 430/536; 430/537; 430/961

(58) Field of Search ..... 430/531, 537, 430/536, 961, 502

(56) References Cited

U.S. PATENT DOCUMENTS

| | | | | |
|---|---|---|---|---|
| 4,914,012 | * | 4/1990 | Kawai | 430/537 |
| 5,061,595 | | 10/1991 | Gingello et al. | 430/531 |
| 5,300,417 | * | 4/1994 | Lushington et al. | 430/537 |
| 5,800,969 | * | 9/1998 | Vandenabeele et al. | 430/537 |

FOREIGN PATENT DOCUMENTS

| | | |
|---|---|---|
| 0 307 855 A2 | 3/1989 | (EP) . |
| 0 307 855 A3 | 3/1989 | (EP) . |
| 0 404 091 A2 | 12/1990 | (EP) . |
| 0 404 091 A3 | 12/1990 | (EP) . |
| 0 520 393 A1 | 12/1992 | (EP) . |
| 0 751 422 A1 | 1/1997 | (EP) . |
| 0 886 177 A1 | 12/1998 | (EP) . |

* cited by examiner

*Primary Examiner*—Richard L. Schilling
(74) *Attorney, Agent, or Firm*—Breiner & Breiner

(57) ABSTRACT

A light-sensitive silver halide photographic material has been provided comprising a support and on one or both sides thereof at least one light-sensitive silver halide emulsion layer, a gelatinous protective antistress layer and, adjacent thereto as an outermost layer, a gelatinous afterlayer characterized in that said afterlayer comprises at least one polymer latex, being a polybutylacrylate, a polybutylmethacrylate latex or a polyurethane latex, or a copolymer latex being a copolymer poly(butyl methacrylate) polyacrylamide N-substituted sulfo-isobutyl salt, in a ratio amount by weight of (co)polymer latex to gelatin from 0.2:1 up to 5:1 and a total amount of (co)polymer latex and gelatin of at least 0.10 g/m$^2$.

8 Claims, No Drawings

LIGHT-SENSITIVE SILVER HALIDE MATERIAL PROVIDING IMPROVED SURFACE CHARACTERISTICS AFTER PROCESSING

Benefit is claimed under 35 USC 119(e) based on Provisional Application No. 60/112,066 filed Dec. 14, 1998.

FIELD OF THE INVENTION

The invention is related to a light-sensitive silver halide photographic material having satisfactory developability, reduced pressure sensitivity and excellent surface characteristics after processing in both hardener containing and hardener free processing.

BACKGROUND OF THE INVENTION

Rapid processing becomes more and more important and therefore the thickness of the light-sensitive hydrophilic colloid layers of a photographic film is reduced and the hardening level is increased. However this causes disadvantages related with pressure sensitivity in the dry state before or in the wet state during processing. Scratch formation in the wet state often occurs and a solution for this may be offered by coating a thicker antistress layer with an increased amount of binder e.g. gelatin. Although these increased amounts have the advantage of giving rise to more surface glare after processing, an inadmissable contamination or sludge formation may occur in the processing solutions. Moreover a thicker antistress layer may retard the processing, resulting in a decreased developability, and drying velocity.

It has been established however that if the processing proceeds in developer and fixer solutions containing hardening agents that after treatment with said solutions and rinsing the film material water is spreaded unevenly on the surface of the processed film material. As a consequence unevenly dried water spots remain on the film after the drying step at the end of the processing cycle as so called "water spot defects".

It has been established otherwise that if the processing proceeds with solutions free from hardening agents problems related with surface characteristics occur as e.g. lack of surface glare and, even more important, unevenness in glare over the processed surface after rapid drying. A solution therefore can be found in EP-A 0 806 705, wherein a method has been disclosed of processing an image-wise exposed light-sensitive silver halide material by the steps of developing, fixing in a fixer solution containing less than 4 g per liter of aluminum ions expressed as an equivalent amount of aluminum sulphate, rinsing and drying; characterized in that said material comprises a support and on one or both sides thereof at least one light-sensitive silver halide emulsion layer and a gelatinous protective antistress layer, wherein said antistress layer comprises at least one polymer latex in such an amount that there is a ratio by weight of latex to gelatin is from 0.5 to 1.5 and wherein said material is hardened to such an extent that its swelling degree after immersing said material for 3 minutes in demineralized water of 25° C. is not more than 300% (a condition which does even not express very high hardening levels). When no aluminum ions are present in the fixer solution as in hardener free processing the problem of "water spot defects" is not as stringent as in the presence thereof.

From practical experience it has been pointed out however that that the presence of a polymer latex in the protective antistress layer in order to avoid uneven surface glare or gloss as set forth in EP-A 0 806 705 leads to lack for developability of the emulsion crystals coated in the light-sensitive silver halide emulsion layer(s) of the silver halide photographic material which causes problems, especially in rapid processing applications.

OBJECTS OF THE INVENTION

Therefore it is a first object of the present invention to provide a light-sensitive silver halide photographic material having satisfactory surface characteristics, particularly reflected in the absence of "water spot defects" due to uneven drying in the processing cycle of automatic processors (in rapid processing cycles from 90 as well as from 45 seconds) and even in manual processing conditions.

It is still a further object of the present invention that all measures taken in order to promote excellent surface characteristics of the film material mentioned hereinbefore lay no burden on the developability (sensitometric properties especially reflected by speed and contrast) of the silver halide emulsion crystals coated in the light-sensitive layer(s) of the said material, especially in the short developing times provided in rapid processing cycles.

Other objects will become apparent from the description hereinafter.

SUMMARY OF THE INVENTION

The above mentioned objects are realized by providing a light-sensitive silver halide photographic material comprising a support and on one or both sides thereof at least one light-sensitive silver halide emulsion layer, a gelatinous protective antistress layer and, adjacent thereto as an outermost layer, a gelatinous afterlayer characterized in that said afterlayer comprises at least one polymer latex, being a polybutylacrylate, a polybutylmethacrylate latex or a polyurethane latex, or a copolymer latex being a copolymer poly(butyl methacrylate) polyacrylamide N-substituted sulfo-isobutyl salt, in a ratio amount by weight of (co) polymer latex to gelatin from 0.2:1 up to 5:1 and a total amount of (co)polymer latex and gelatin of at least 0.10 $g/m^2$.

Specific features for preferred embodiments of the invention are disclosed in the dependent claims.

Further advantages and embodiments of the present invention will become apparent from the following description.

DETAILED DESCRIPTION OF THE INVENTION

Preferred (co)polymer latices used in the protective antistress layer and/or outermost afterlayer of the light-sensitive silver halide material according to the present invention are cross-linked polymers and can be prepared as described e.g. in U.S. Pat. No. 4,301,240 by emulsion polymerisation of aliphatic esters of acrylic and/or methacrylic acid in water in the presence of polyfunctional cross-linking monomers and an emulsifier, followed by saponification of the obtained copolymer. By said emulsion polymerisation copolymers with a molecular weight well above 500,000 are obtained and the average particle size of the latex is smaller than 150 nm. Another example of the synthesis of ionic cross-linked copolymers can further be found e.g. in EP-A 0 452 568 and the corresponding U.S. Pat. No. 5,472,832.

In photographic material of the present invention a particularly preferred latex of an ionic copolymer for use in the gelatinous protective antistress layer of a light-sensitive silver halide material is a copolymer of butyl methacrylate and acrylamide-N-isobutylsulphonic acid sodium salt as represented in the formula (I).

(I)

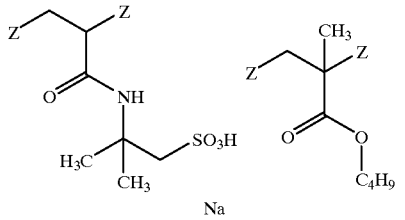

In one embodiment in the copolymer according to the formula (I) suitable for use in the material according to the present invention a ratio amount of butylmethacrylate and and acrylamide-N-isobutyl-sulphonic acid sodium salt is at least 80:20 and more preferably about 95:5.

Other preferred latex compounds are polybutylacrylate and polybutylmethacrylate as examples of non-ionic polymer latex compounds. It is not excluded to use them in combination, e.g. in a mixture with each other or even with other polymers dispersed as a latex as there are polymethylmethacrylate, polymethylacrylate, polyethylacrylate latex compounds and the like. Average particle sizes of the latex particles are in the range from about 50 nm up to about 115 nm as for the latex copolymer according to the formula (I) given hereinbefore.

Another particularly preferred latex is a polyurethane latex, which is preferably in the form of a dispersion of an aliphatic anionic polyurethane. In praxis the commercially available product IMPRANIL 43056, trademarked product from BAYER AG, Leverkusen, Federal Republic of Germany is very suitable. This IMPRANIL-latex is a 40% aqueous dispersion of polyurethane prepared from DESMODUR W (trademarked product from BAYER AG), which is a dicyclohexylmethane diisocyanate, and a polyester having a low molecular weight of about 800. The average particle size of the latex may vary between 0.02 and 0.2 $\mu$m The polyurethane is added to the coating solution as an aqueous latex dispersion. An especially useful polyurethane is the one having a high procentual amount of urethane groups, in order to get a high degree of cross-linking and as a consequence low tendency to sticking. Moreover the presence of a lubricant in an outermost afterlayer on top of the protective antistress layer comprising said polyurethane dispersion may be favorable. Said polyurethane latex can moreover be loaded with e.g. a developing agent by addition of the aqueous loadable polyurethane latex to a solution of useful agent(s) as e.g. a developing agent in a water-miscible organic solvent e.g. acetone, or by simultaneous addition of said latex and said solution to an aqueous gelatinous solution as gelatin is a preferred binder for this loaded latex. A mixture of developing agents including a dihydroxybenzene like hydroquinone and a 3-pyrazolidine-1-one developing agent as e.g. 1-phenyl-3-pyrazolidine-1-one also known as "phenidone", being an electron transfer agent or super additive developer, can be used in combination, in that case preferably in a respective molar ratio of from 2/1 to 10/1. In that case dihydroxybenzene or dihydroxybenzenes is(are) preferably present in an amount of from 0.05 to 0.5 g for a coverage of silver halide equivalent with 1 g of silver nitrate. Ascorbic acid, iso-ascorbic acid whether or not in combination with the preferred developing agent(s) can also be used. In this way a so-called "activation material" can be obtained which can be developed by means of an alkaline solution. In a preferred embodiment the material according to the present invention when comprising a polyurethane as polymer latex, said latex is an aliphatic anionic polyurethane.

It is clear that different latex (co)polymers can be added to the gelatinous protective antistress layer and/or to the gelatinous afterlayer: mixtures thereof can be added in different amounts.

In the present invention one or more latex (co)polymer(s) is(are) optionally present in the gelatinous protective antistress layer as the objects of the present invention are also fulfilled when said protective antistress layer is free from any polymer latex. It is however required for the latex (co)polymer(s) to be at least present in the outermost gelatinous afterlayer of the material according to the present invention: at least one (co)polymer latex in a ratio amount by weight of (co)polymer latex to gelatin from 0.2:1 up to 5:1, and more preferably in a ratio of from 0.3:1 up to 3:1, and a total amount of (co)polymer latex and gelatin of at least 0.10 g/m$^2$ is required.

According to the present invention said material has a total amount of (co)polymer latex and gelatin of up to 1.2 g/m$^2$ in said outermost gelatinous afterlayer, which is in favor of better spreading of water in the rinsing step (and even drying properties or absence of "water spot defects") and in favor of pressure sensitivity. For reasons of developability it is however preferred not to add higher amounts as otherwise sensitometry may be influenced, especially in rapid processing conditions.

Preferred amounts of gelatin in said outermost afterlayer are in the range from 0.10–0.40 g/m$^2$, whereas preferred amounts of latex (co)polymer(s) are in the range from 0.05–0.60 g/m$^2$ and more preferably in the range from 0.10–0.40 g/m$^2$.

More particularly in order to lay no burden on developability the material according to the present invention is coated with an amount of gelatin as a binder material (known as gelatin coverage) in the protective antistress coating of not more than than 1.5 g per m$^2$ and more preferably in the range of from 0.20 to 1.0 g per m$^2$ and in the outermost afterlayer the gelatin coverage is in the range of from 0.05 to 0.50 g per m$^2$, more preferably from 0.10 to 0.40 g per m$^2$ and still more preferably from 0.20 to 0.40 g per m$^2$.

As the material according to the present invention is also intended to be processable in a developer and a fixer without hardeners (like the environmental unfriendly glutaraldehyd) the material of the present invention is hardened to such an extent that its swelling degree after immersing said material for 3 minutes in demineralized water of 25° C. is not more than 300%, and even more preferably less than 200%. Especially for application in processing cycles of less than 50 seconds said swelling degree should not be higher.

The said latex-type (co)polymers may further optionally be present in one or more emulsion layer(s) coated between the protective antistress layer and a subbed support, the subbing layer of which may be overcoated with at least one gelatinous intermediate layer.

Layers and layer arrangements which can be applied to the film material, apart from the requirement to have an afterlayer, coated adjacent and as an outermost layer of the material of the present invention are those described in U.S. Pat. Nos. 4,092,168; 4,311,787 and 5,693,370 and in EP-A's 0 712 034; 0 712 036; 0 677 773; 0 678 772; 0 610 608; 0 610 609 and 0 569 075, in DE- A 2,453,217 and in GB-A 7,907,440.

In the antistress layer and in the afterlayer of the material of the present invention comprising (whether or not optionally as for the protective antistress layer) a polyurethane latex and/or the latex-type polymers or copolymers described hereinbefore, hydrophilic colloid binders differing from gelatin that can be homogeneously mixed therewith may be present and are e.g. other proteinaceous colloids, polysaccharides as e.g. starch and polydextranes, as well as synthetic substitutes for gelatin as e.g. poly-N-vinylpyrrolidone, polyvinyl alcohol, polyacrylamide, polyacrylic acid, polyamethyl-acrylate, polyethyl-acrylate, polymethyl-methacrylate, polyethyl-methacrylate, polyvinyl imidazole, polyvinyl pyrazole and derivatives thereof as well as styrene-maleïc acid or a styrene-maleïc acid anhydrid type copolymer. To the ionic or non-ionic latex polymers can be added in addition non-ionic surfactants such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone polyethylene oxide adducts, glycidol derivatives, fatty acid esters of polyhydric alcohols and alkyl esters of saccharides; anionic agents comprising an acid group such as a carboxy-, sulpho-, phospho-, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Furthermore the use of mixtures of said hydrophilic colloids is not excluded. Among these binders as already set forth hereinbefore the most preferred one is gelatin. Conventional lime-treated or acid treated gelatin can be used. The preparation of such gelatin types has been described in e.g. "The Science and Technology of Gelatin", edited by A. G. Ward and A. Courts, Academic Press 1977, p. 295 and next pages. The gelatin can also be an enzyme-treated gelatin as described in Bull. Soc. Sci. Phot. Japan, N° 16, p.30 (1966).

In order to minimize the amount of gelatin, said gelatin can be replaced in part or integrally by synthetic polymers as cited hereinbefore or by natural or semi-synthetic polymers. Natural substitutes for gelatin are e.g. other proteins such as zein, albumin and casein, cellulose, saccharides, starch, and alginates. Semi-synthetic substitutes for gelatin are modified natural products as e.g. gelatin derivatives obtained by conversion of gelatin with alkylating or acylating agents or by grafting of polymerisable monomers on gelatin, and cellulose derivatives such as hydroxyalkyl cellulose, carboxymethyl cellulose, phthaloyl cellulose, and cellulose sulphates.

In a preferred embodiment gelatin in the antistress layer is partially replaced by colloidal silica as it gives rise to a further improvement of the obtained properties of the material according to the present invention. Preferably colloidal silica having an average particle size of not larger than 10 nm and having a surface area of at least 300 $m^2$ per gram is used. Especially preferred colloidal silica particles have a surface area of 500 $m^2$ per gram and an average grain size smaller than 7 nm. Such type of silica is sold under the name KIESELSOL 500 (KIESELSOL is a registered trade name of Bayer AG, Leverkusen, West-Germany). Colloidal silica is preferably present at a coverage of at least 50 mg per $m^2$. Further the coverage of said colloidal silica in the anti-stress layer is preferably in the range of 50 mg to 500 mg per $m^2$.

In admixture with the hardened gelatin the antistress layer may further contain friction-lowering substance(s) such as dispersed wax particles (carnaubawax or montanwax) or polyethylene particles, fluorinated polymer particles, silicon polymer particles etc., in order to further reduce the sticking tendency of the layer especially in an atmosphere of high relative humidity.

The gelatin binder can be forehardened with appropriate hardening agents such as those of the epoxide type, those of the ethylene-imine type, those of the vinylsulfone type as e.g. 1,3-vinylsulphonyl-2-propanol, bis-vinyl-sulphonyl methyl or bis-vinyl sulphonyl ethyl ether, hydroxy substituted vinyl sulphonyl hardeners, chromium salts as e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives as e.g. 2,3-dihydroxy-dioxan, active vinyl compounds as e.g. 1,3,5-triacryloyl-hexahydro-s-triazine, active halogen compounds as e.g. 2,4-dichloro-6-hydroxy-s-triazine, and mucohalogenic acids as e.g. mucochloric acid and mucophenoxy-chloric acid. These hardeners can be used alone or in combination. The binder can also be hardened with fast-reacting hardeners such as carbamoylpyridinium salts as disclosed in U.S. Pat. No. 4,063,952 and with the onium compounds disclosed in EP-A 0 408 143.

To the ionic or non-ionic latex polymers or latex co-polymeric combinations of monomers cited hereinbefore can optionally be added in addition non-ionic surfactant(s) having antistatic characteristics such as e.g. polyoxyethylene compounds. In a more preferred embodiment the said surfactant(s) is(are) present in an optionally present outermost layer. Said layer may be a gelatin free afterlayer or a thin gelatinous layer. In a preferred embodiment a latex (co)polymer having antistatic properties is added to the protective antistress layer containing the latex (co)polymer (s) set forth hereinbefore. Said latex (co)polymer is present in an amount of up to 0.5 g/$m^2$ per side. A preferred one is the latex of a cross-linked polymer, being a copolymer of an acrylic and/or methacrylic acid ester including 90–99 mole % of acrylate and/or methacrylate units and 1 to 10 mole % of tetraallyloxyethane units as polyfunctional crosslinking monomer, wherein in said copolymer at least 75% of the ester groups have been transformed into alkali metal carboxylate groups, thus exhibiting ionic characteristics: especially preferred as a cross-linked ionic polymer is poly([c.1.] tetraallyloxyethane-co-methyl acrylate/acrylic acid), the formula (II) of which is given hereinafter with a preferable 3/18/79 molar ratio.

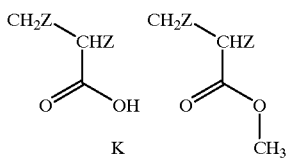

K

-continued (II)

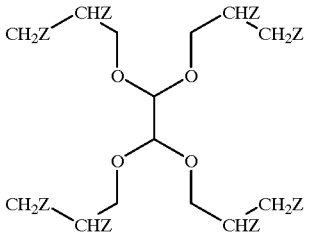

Other antistatic agents can be provided therein as has e.g. been given in U.S. Pat. No. 5,391,472. The afterlayer may further comprise spacing agents and coating aids such as wetting agents as e.g. perfluorinated surfactants. Spacing agents which may also be present in the protective antistress layer in generally have an average particle size which is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The coating of the layers of the material of the present invention may proceed by any coating technique known in the art, as e.g. by doctor blade coating, air knife coating, curtain coating, slide hopper coating or meniscus coating, which are coating techniques known from the production of photographic silver emulsion layer materials.

In order to regulate the viscosity of the coating solutions used for any of the said coating techniques provided that they do not particularly affect the photographic characteristics of the silver halide light-sensitive photographic material. Preferred thickening agents include aqueous polymers such as polystyrene sulphonic acid, sulphuric acid esters, polysaccharides, polymers having a sulphonic acid group, a carboxylic acid group or a phosphoric acid group, polyacrylamide, polymethacrylic acid or its salt, copolymers from acrylamide and methacrylic acid and salts derived thereof, copolymers from 2-acrylamido-2-methyl-propane sulphonic acid, polyvinyl alcohol, alginate, xanthane, carraghenan, synthetic (smectite) clays and the like. Polymeric thickeners well-known from the literature resulting in thickening of the coating solution may be used independently or in combination. Patents concerning thickening agents are e.g. U.S. Pat. No. 3,167,410, Belgian Patent No. 558.143, JP-A's 53/18687 and 58/36768 and DE-A 3 836 945.

In addition to the binder(s), silver halide(s) and, optionally, developing agent(s) the silver halide photographic material may contain in the light-sensitive emulsion layer(s) and/or in one or more layers in water-permeable relationship with said silver halide emulsion layer(s) any of the kinds of compounds customarily used in such layers for improving the photographic process, manufacture or preservability (storage). For example such layers may incorporate one or more coating aids, stabilising agents or antifogging agents as described e.g. in GB-A 1,007,020 filed Mar. 6, 1963 by Agfa A. G., plasticizers, development-modifying agents e.g. polyoxyalkylene compounds, onium compounds, and sulphur compounds of the class which have sulphur covalently bound derived from an ion such as a mercaptide or xanthate or coordinately bound sulphur from a thioether. Preferably thioethers acting as silver chelating agents with at least two sulphur atoms as donors are used. A survey of thioether compounds suitable for incorporation in silver halide emulsion layers of widely varying silver halide composition has been given in the EP-A 0 026 520. Useful compounds have further been described in EP-A's 0 634 688 and 0 674 215.

Silver halide emulsion crystals used in the silver halide emulsion layer(s) of the material of the present invention are composed of silver chloride, silver chlorobromide, silver chloroiodide, silver chlorobromoiodide, silver bromide or silver bromoiodide. Regular as well as tabular crystals may be present, as well as mixtures thereof. Crystals having a different crystal habit may be coated in different layers as e.g. in EP-A 0 770 909.

In view of developability amounts of iodide of not more than 2 mole % are preferred in said silver halide crystals and even more preferred is an iodide content of from 0.1 to 1 mole %. Silver halide crystals having a regular crystal habit preferably have an average grain size of at least 0.15 μm, up to at most 1.2 μm, more preferably up to 1.0 μm and still more preferably up to 0.8 μm. Silver halide crystals having tabular {111} major faces accounting for at least 50% of the total projected area preferably have an average diameter from 0.5 to 2.5 μm and an average thickness from 0.06 to at most 0.3 μm, and even more preferred to at most 0.2 μm. Average aspect ratios of from 2 to 20 and more preferred from 5 to 15 are preferred. Said silver halide crystals may have been prepared in gelatin and/or in colloidal silica as a protective colloid. Preparations in colloidal silica have e.g. been described, in EP-A's 0 677 773; 0 682 287; 0 649 051 and 0 754 964.

Supports and subbing layers coated adjacent thereto, useful for the film materials according to the present invention, can be those as described in RD 36544 (published September 1994), chapter XV, polyethylene naphthalate inclusive.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. Nos. 3,397,988, 3,649,336, 4,123,278 and 4,478,907. For high speed processing applications a useful subbing layer is disclosed e.g. in JP-A 01 166 031. Vinylidene chloride and styrene-butadiene copolymers are the most well-known polymers for practical use as subbing layer ingredients in the material to be processed according to the method of the present invention.

Photographic silver halide emulsion materials, suitable for use in the processing method of this invention are materials for continuous tone or halftone photography, microphotography and radiography, in black-and-white as well as color photographic materials. Said materials are thus selected from the group consisting of materials having one or more light-sensitive silver halide emulsion layers at one or at both sides of the support.

According to the present invention preferred materials are X-ray materials, single-side as well as double side coated, and more preferred medical X-ray materials.

Said materials may be imagewise exposed by means of any radiation source, depending on their application as has been described e.g. in RD 36544, chapter XVI.

Ecological advantages of the processing method of said imagewise exposed materials according to the present invention are related with the use of fixer solutions ready-for-use containing less than 4 g of aluminum per liter expressed as an equivalent amount of aluminum sulphate. A already told the developer is free from the generally used well-known glutardialdehyde hardener. A time saving factor is the total processing time: rapid processing proceeds within a time of less than 90 seconds, more preferred within a time of less than 50 seconds e.g. within a time from 20 to 45 seconds, in automatic processing machines as e.g. CURIX HT 530, trade marketed product from Agfa-Gevaert N.V.

For ecological reasons fixers having high sodium thiosulphate concentrations are preferred over fixers containing ammonium thiosulphate. They are useful in those circumstances wherein no replenishment system is available or where it is desirable to minimize the replenishment amounts. Such fixers retain a high silver binding capacity and a sufficient fixing speed even after prolonged continuous processing without replenishment or with minimum replenishment. An example thereof has been given in Research Disclosure 355 039, p. 736–737, published Nov. 1, 1993.

In order to reduce or to minimize odor by formation of sulphur dioxide fixation proceeds in a fixer at a pH value of at least 4.6 and even more preferred in a fixer having a pH value of at least 5.0, a condition which can be better fulfilled the lower the concentration of aluminum ions is as precipitation of aluminum hydroxyde should be avoided. In the most preferred embodiment no aluminum is present at all as has already been established hereinbefore.

After fixing and rinsing, drying preferably proceeds by means of infrared drying means as has e.g. been described in EP-A 0 620 482 for non-destructive testing film materials. In these drying circumstances improvement of surface characteristics is in the best mode, especially thanks to the composition of the antistress layer.

As a result use of a material according to the present invention offers, after rapid processing in hardener free developers and fixers as well as in hardener containing developers and fixers (wherein fixing preferably proceeds in the presence of low amounts of aluminum, preferably less than 4 g per liter of aluminum ions expressed as an equivalent amount of aluminum sulphate, having a pH value of at least 4.6 in order to avoid odor or smell), the desired properties, being absence of or significant reduction of water spot defects without loss of developability as can be concluded from sensitometric properties (especially speed and contrast) in rapid processing conditions (45" processing, in automatic processing machines as well as in manual processing). In case of hardener free processing an excellent glare or gloss level is retained after said processing, again without loss in developability.

EXAMPLES

Preparation Method of the Photographic Material

A photographic material was prepared composed of a subbed polyester base (175 μm thick);

an emulsion layer comprising a mixture of two gelatinous silver halide emulsions (preparation described hereinafter) of which the silver halide consists for 99 mole % of silver bromide and 1 mole % of silver iodide having a {111} tabular crystal habit;

a protective antistress layer having the composition given hereinafter.

an afterlayer as an outermost layer (in the examples where it applies)

Preparation of the tabular silver bromoiodide emulsion A.

Solutions (Held at 55° C.)

solution 1: 1.96 molar of an aqueous silver nitrate solution.

solution 2: 1.96 molar of an aqueous potassium bromide solution.

solution 3: mixture containing 1.93 molar of an aqueous potassium bromide solution and 0.03 molar of an aqueous potassium iodide solution.

Nucleation Step 28 ml of solutions 1 and 2 were introduced into a reaction vessel in 28 seconds using the double jet technique. Said reaction vessel initially contained 2.127 liter of destilled water at 45° C., 10.6 grams of potassium bromide and 6 grams of inert gelatin and was held at 55° C. After one minute the reaction temperature of this mixture was raised to 70° C. in 20 minutes and 47.5 grams of phthalated gelatin in 475 ml destined water were added. After 10 minutes the neutralization step was started.

During nucleation the stirring velocity in the reaction vessel was held at 150 rpm.

Neutralization Step 21.25 ml of solution 1 were added to the reaction vessel at a rate of 7.5 ml per minute to reach a UAg value (potential versus silver/silver chloride reference electrode) of +10 mV, whereafter the first growth step was started.

First Growth Step

A double jet precipitation was started using solutions 1 and 2: during 1 minute solution 1 was added at a flow rate of 7.5 ml per minute, while solution 2 was added at a rate of 7.7 ml/min., meanwhile maintaining the UAg value at+10 mV.

The double jet precipitation continued for 31 min. 30 seconds at a flow rate while increasing the rate of solution 1 up to 22.2 ml per minute and solution 2 up to 22.6 ml per minute, meanwhile maintaining the UAg value at +10 mV again.

Thereafter the second neutralization phase was started.

Second Neutralization Step 26.25 ml of solution 1 was added at a rate of 7.5 ml per minute in 3 min. 30 seconds so that a UAg value of +100 mV was obtained. The precipitation was then continued by a second growth step.

Second Growth Step

During 30 seconds solution 1 was injected in the reaction vessel at a flow rate of 7.5 ml per minute, while solution 3 was injected at the same flow rate. After increasing the stirring velocity up to 550 rpm during 30 seconds, the flow rates were increased during 41 minutes and 50 seconds up to 37.5 ml per minute, meanwhile maintaining a UAg value in the reaction vessel of +100 mV. The stirring velocity was decreased from 550 to 250 rpm.

The tabular grains of the emulsion thus obtained had the following characteristics, measured with electron microscopic techniques:

average equivalent circular diameter (ECD): 1.04 μm coefficient of variation of the tabular grains on ECD: 0.30 average thickness: 0.22 μm average aspect ratio: 4.8 percentage of total projective surface: 93%.

Washing and Dispersing Procedure

After the emulsion precitation was ended the pH value was lowered to 3.5 with diluted sulphuric acid and the emulsion was washed using demineralized water of 11° C. At 45° C. to the flocculate, having a volume of 1350 ml gelatin was added in order to have a gesi (ratio in grams of gelatin to silver) of 0.34 and demineralized water was added in order to have a total weight of 1923 grams. Values of pH and UAg at 40° C. were adjusted to 5.5 and +100 mV.

Sensitization

The dispersed emulsion was optimally sulphur and gold sensitized in the presence of sodium thiocyanate and anhydro-5,5'-dichloro-3,3'-bis(n.sulfobutyl)-9-ethyloxacarbocyanine hydroxide.

Preparation of the tabular silver bromoiodide emulsion B.

Solutions solution 1: 1.96 molar of an aqueous silver nitrate solution.

solution 2: 1.96 molar of an aqueous potassium bromide solution.

solution 3: mixture containing 1.93 molar of an aqueous potassium bromide solution and 0.03 molar of an aqueous potassium iodide solution. Solutions were held at 55° C.

Nucleation Step 16.3 ml of solutions 1 and 2 were introduced into a reaction vessel in 35 seconds using the double jet technique. Said reaction vessel initially contained 2.127 liter of destined water at 45° C., 10.6 grams of potassium bromide and 6 grams of inert gelatin and was held at 55° C. After one minute the reaction temperature of this mixture was raised to 70° C. in 20 minutes and 47.5 grams of phthalated gelatin in 475 ml destined water were added.

During nucleation the stirring velocity in the reaction vessel was held at 150 rpm. Before the first growth step the stirring velocity was increased up to 400 rpm.

First Growth Step

A double jet precipitation was started using solutions 1 and 2: during 1 minute solution 1 was added at a flow rate of 7.5 ml per minute, while solution 2 was added at a rate of 7.9 ml/min., meanwhile maintaining the UAg value (potential versus silver/silver chloride reference electrode) at −15 mV.

The double jet precipitation continued for 35 min. 38 seconds at a flow rate while increasing the rate of solution 1 up to 14.4 ml per minute and solution 2 up to 15.2 ml per minute, meanwhile maintaining the UAg value at −15 mV again.

Thereafter the second neutralization phaze was started.

Neutralization Step 75 ml of solution 1 was added at a rate of 7.5 ml per minute in 10 min. so that a UAg value of +100 mV was obtained. The precipitation then continued by a second growth step.

Second Growth Step

During 60 seconds solution 1 was injected in the reaction vessel at a flow rate of 7.5 ml per minute, while solution 3 was injected at the same flow rate. The flow rates were increased during 59 minutes and 30 seconds up to 22.5 ml per minute, meanwhile maintaining a UAg value in the reaction vessel of +100 mV.

The stirring velocity was thereafter decreased to 250 rpm.

The tabular grains of the emulsion thus obtained had the following characteristics, measured with electron microscopic techniques:

average equivalent circular diameter (ECD): 1.30 μm coefficient of variation of the tabular grains: 0.40 average thickness: 0.23 μm average aspect ratio : 6.0 percentage of total projective surface: 92%.

Washing and Dispersing Procedure

After the emulsion precitation was ended the pH value was lowered to 3.5 with diluted sulphuric acid and the emulsion was washed using demineralized water of 11° C. At 45° C. to the flocculate, having a volume of 1250 ml, gelatin was added in order to have a gesi (ratio in grams of gelatin to silver) of 0.34 and demineralized water was added in order to have a total weight of 1923 grams. Values of pH and UAg at 40° C. were adjusted to 5.5 and +100 mV.

Sensitization

The dispersed emulsion was optimally sulphur and gold sensitized in the presence of sodium thiocyanate and anhydro-5,5'-dichloro-3,3'-bis(n.sulfobutyl)-9-ethyl-oxacarbocyanine hydroxide.

Stabilization and Preparation of the Emulsion Coating Solutions

Each emulsion was stabilized with 4-hydroxy-6-methyl-1,3,3a,7-tetraazaindene. Both emulsions were mixed in order to get a ratio by weight of Emulsion A to Emulsion B of 4:1, gelatin was added and after addition of the normal coating additives the solutions were coated simultaneously together with a protective layer containing a variable amount of gelatin as indicated in Table 1 per $m^2$ and per side on both sides of a polyethylene terephthalate film support with a thickness of 175 μm.

Protective Antistress

The said protective antistress layer was coated with the following compounds, expressed in grams per square meter per side:

gelatin $x_1$ g polymethylmethacrylate 0.023

(average particle diameter: 6 μm)

1-p-carboxyphenyl-4,4'-dimethyl-3-pyrazolidine-1-one 0.054 oleyl-$(OCH_2CH_2)_{10}OH$ (absent in the presence of an afterlayer) 0.056 formaldehyd(added just before coating) 0.1

$CF_3$—$(CF_2)_6$—$COOH.NH_3$ (absent in the presence of an afterlayer) 0.007

Polymer latex given in formula (I) hereinbefore was added in variable amounts ($y_1$ g) as indicated in the same Table I.

Afterlayer (Outermost Layer) if Present in the Examples gelatin $x_2$ g oleyl-$(OCH_2CH_2)_{10}OH$ 0.056

$CF_3$—$(CF_2)6$—$COOH.NH_3$ 0.007

Polymer latex given in formula (I) hereinbefore was added in variable amounts ($y_2$ g) as indicated in the Tables where it applies.

Coating

Use was made of the slide hopper coating technique for simultaneous application of the emulsion coating in the silver halide containing layer, the antistress coating and the afterlayer.

The resulting photographic material contained per side an amount of silver halide corresponding to 3.89 grams of $AgNO_3$ Exposure, Sensitometric and Densitometric Data Samples of these coatings were exposed with green light of 540 nm during 0.1 seconds using a continuous wedge and were and 2.16 g of gelatin per $m^2$.processed during the 45 seconds cycle described below. The density as a function of the light dose was measured and therefrom were determined the following parameters:

fog level F (with an accuracy of 0.001 density);

sensitivity S at a density of 1 above fog measured as log E(xposure): a lower value is indicative for a higher sensitivity;

contrast C, calculated between densities 0.25 and 2.0 above fog.

Surface Properties

"Water spot defects", "gloss" and "pressure sensitivity" were evaluated as follows.

Water spot defects (WSD) occurring as a consequence of an uneven spreading of water over the processed film material surface while drying in the processing unit in automatic processing has been evaluated qualitatively by giving a figure from "0" to "5", wherein "0" means "excellent" (no water spots, even drying, good spreading of water over the processed film surface before drying it) and "5" means "very bad" (clearly observed water spots as a consequence of uneven drying properties of badly spreaded water over the film surface). A value of "3" is still acceptable. Therefore 2 samples of each material having A4 format were exposed to white light in order to get a maximum density after processing for 90 seconds in an automatic processor (Kodak RP X-O-MAT Model M6B (M6/5)) with the hardening-containing developer G138® (glutardialdehyd) and fixer G334® (with aluminum ions). As a reference having a figure of "5" for "water spot defects" Curix® Ortho DGA 39500162 was taken. After processing 2 samples of the reference material, immediately followed by two samples of the test material, there was a waiting time of 3 minutes before another 2 samples of the reference material, immediately followed by two samples of another test material were processed. All samples were visually evaluated on the appearance of unevenly distibuted water spots on its dried surface versus the 2 reference samples which had been run through the processing immediately before the said samples.

Gloss or glare unevenness was tested after processing in a 45 seconds hardener free processing cycle in Curix HT-530®, the composition of the hardener free developer and fixer of which has been given hereinafter. Samples were exposed to white light in order to get a maximum density after processing. Processed samples were dried at maximum drying position "7". A visual evaluation proceeds after processing wherein attention is especially paid to the evenness of the gloss or glare: "0" means "excellent, even gloss"; "5" means "uneven gloss or glare" after observation of the processed and dried film surface under an angle in order to make a good observation possible.

Pressure sensitivity (PS) was controlled by exposure of a material sample through a continuous wedge, whereafter a wheel was run several times over parallel sites of the exposed material with differing pressure. Blackening of the sites where the wheel had been run was evaluated after manual processing of the strips: no blackening was interpreted as "excellent, showing no pressure sensitivity" corresponding with a figure of "0"; appearance of high blackening densities was interpreted as "bad, showing high pressure sensitivity" corresponding with a figure of "5".

Processing Conditions

The processing conditions and the composition of the processing solutions is given hereinafter. The processing of the described photographic materials in accordance with this invention proceeds in the processing machine CURIX HT530™ (Agfa-Gevaert) with following time (in seconds) and temperature (in °C.) characteristics:

| | | |
|---|---|---|
| loading | 0.2 sec. | |
| developing | 9.3 sec. | 35° C. (developer G138 ®, Agfa-Gevaert NV) |
| cross-over | 1.4 sec. | |
| rinsing | 0.9 sec. | |
| cross-over | 1.5 sec. | |
| fixing | 6.6 sec. | 35° C. (fixer G334 ®, Agfa-Gevaert NV) |
| cross-over | 2.0 sec. | |
| rinsing | 4.4 sec. | 20° C. |
| cross-over | 4.6 sec. | |
| drying | 6.7 sec. | |
| total | 37.6 sec. | |

Example 1 (Comparative)

As a series of comparative X-ray photographic materials materials were prepared with on top a protective antistress layer covering the silver halide emulsion layer, thus in the absence of an afterlayer. Sensitometric results are summarized in Table 1.

TABLE 1

| Film | Fog F (× 1000) | Speed S (× 100) | Contrast C | $x_1$ g/m$^2$ of gelatin | $y_1$ g/m$^2$ of polymer latex | Water spot defects. | Pressure Sensitivity |
|---|---|---|---|---|---|---|---|
| A' | 23 | 158 | 3.09 | 1.10 | 0.00 | 4.5 | 2.5 |
| B' | 22 | 159 | 2.99 | 1.10 | 0.30 | 4.5 | 2.5 |
| C' | 22 | 160 | 2.87 | 1.10 | 0.60 | 4.5 | 2 |
| D' | 22 | 161 | 2.66 | 1.10 | 1.10 | 4.5 | 1.5 |
| E' | 21 | 158 | 3.05 | 0.65 | 0.00 | 4 | 3.5 |
| F' | 19 | 160 | 2.85 | 0.65 | 0.65 | 4.5 | 2.5 |
| G' | 21 | 157 | 2.99 | 0.20 | 0.00 | 3 | 4.5 |
| H' | 18 | 158 | 3.03 | 0.20 | 0.20 | 3 | 3.5 |

These comparative materials A'–H' without afterlayer, having an analoguous composition as those described in EP-A 0 806 705 and the corresponding U.S. Pat. No. 5,800,969, are not satisfying the requirements of the present invention as water spot defects and pressure sensitivity are not sufficient simultaneously as becomes clear from the figures in Tabel 1. These results are obviously not related with sensitometric differences as said differences are negligible, although a trend to lower contrast (as e.g. for D') is present.

Example 2

In Table 2 hereinafter data have been given for materials which have been coated with an afterlayer as outermost layer as described hereinbefore with variable amounts of gelatin ($x_2$) and polymer latex ($y_2$) but without enhancing the total coating amount of gelatin and polymer latex over the protective layer and the afterlayer (total amount: 1.1 g for all materials). Differences in the protective antistress layers for amounts of gelatin ($x_1$) and polymer latex ($y_1$) have also been given.

TABLE 2

| Film | F | S | C | $x_1$ g/m² of gelatin | $y_1$ g/m² polymer latex | $x_2$ g/m² of gelatin | $y_2$ g/m² polymer latex | WSD | PS |
|---|---|---|---|---|---|---|---|---|---|
| A(comp) | 23 | 158 | 3.09 | 1.10 | 0.00 | 0.00 | 0.00 | 4.5 | 2.5 |
| B(comp) | 18 | 159 | 2.89 | 0.55 | 0.55 | 0.00 | 0.00 | 4.0 | 3.0 |
| C(comp) | 22 | 158 | 3.09 | 1.00 | 0.00 | 0.10 | 0.00 | 5.0 | 3.0 |
| D(inv) | 21 | 158 | 3.10 | 0.95 | 0.00 | 0.10 | 0.05 | 3.0 | 3.0 |
| E(inv) | 20 | 158 | 3.11 | 0.90 | 0.00 | 0.10 | 0.10 | 2.0 | 2.5 |
| F(inv) | 25 | 158 | 2.13 | 0.80 | 0.00 | 0.10 | 0.20 | 2.0 | 2.5 |
| G(comp) | 22 | 158 | 3.08 | 0.90 | 0.00 | 0.20 | 0.00 | 5.0 | 3.0 |
| H(inv) | 20 | 158 | 3.08 | 0.80 | 0.00 | 0.20 | 0.10 | 3.0 | 3.0 |
| I(inv) | 19 | 158 | 3.09 | 0.70 | 0.00 | 0.20 | 0.20 | 2.0 | 3.0 |
| J(inv) | 22 | 158 | 3.09 | 0.50 | 0.00 | 0.20 | 0.40 | 2.0 | 2.5 |
| K(comp) | 21 | 158 | 3.06 | 0.70 | 0.00 | 0.40 | 0.00 | 5.5 | 3.0 |
| L(inv) | 19 | 158 | 3.05 | 0.50 | 0.00 | 0.40 | 0.20 | 3.0 | 2.5 |
| M(inv) | 18 | 159 | 3.04 | 0.30 | 0.00 | 0.40 | 0.40 | 1.0 | 2.5 |

Apart from the excellent developability, reflected in the sensitometric data from Table 2 which are almost constant for the materials A–M (except for B where too low a contrast is measured), it is clear that as long as the ratio by weight of polymer latex and gelatin in the afterlayer is more than 0.3 and as long as the total amount of polymer latex and gelatin does not exceed a value of about 0.8 g/m² materials having negligible water spot defects and negligible pressure sensitivity are obtained as is the case for the materials D,E,F,H, I,J,L and M.

Example 3

In Table 3 hereinafter data have been given for materials which have been coated with an afterlayer as described hereinbefore with variable amounts of gelatin ($x_2$) and polymer latex ($y_2$) but without making use of a polymer latex in the protective antistress layer, wherein a constant amount of gelatin has been coated of $x_1$ 1.1 g/m² for each material N–V. Differences in the total amounts of the sum of gelatin ($x_1$+$x_2$) and polymer latex ($y_2$, as $y_1$=0) have also been given as well as ratios of polymer latex and gelatin in the afterlayer ($y_2/x_2$).

TABLE 3

| Film | F | S | C | $x_{1+x2}$ + $y_2$ in g/m² | $y_2$ g/m² polymer latex | $x_2$ g/m² of gelatin | $y_2/x_2$ | WSD | PS |
|---|---|---|---|---|---|---|---|---|---|
| N | 30 | 158 | 3.16 | 1.40 | 0.20 | 0.10 | 2.00 | 1.5 | 2.5 |
| O | 23 | 158 | 3.11 | 1.30 | 0.00 | 0.20 | 0.00 | 5.0 | 2.5 |
| P | 22 | 158 | 3.12 | 1.40 | 0.10 | 0.20 | 0.50 | 3.0 | 2.5 |
| Q | 22 | 158 | 3.13 | 1.50 | 0.20 | 0.20 | 1.00 | 1.5 | 2.5 |
| R | 30 | 158 | 3.16 | 1.70 | 0.40 | 0.20 | 2.00 | 1.5 | 2.5 |
| S | 22 | 157 | 3.11 | 1.60 | 0.10 | 0.40 | 0.25 | 4.0 | 2.5 |
| T | 22 | 157 | 3.12 | 1.70 | 0.20 | 0.40 | 0.50 | 3.0 | 2.5 |
| U | 22 | 157 | 3.13 | 1.90 | 0.40 | 0.40 | 1.00 | 1.5 | 2.5 |
| V | 30 | 157 | 3.16 | 2.30 | 0.80 | 0.40 | 2.00 | 1.0 | 2.0 |

As becomes clear from Table 3 hereinbefore, even in the absence of any polymer latex in the protective antistress layer very good figures indicating low pressure sensitivity and absence of water spot defects are obtained, provided that at least a polymer latex is present in the afterlayer.

In the range from about 1:1 up to at least 2:1 for ratios by weight of polymer latex and gelatin in the afterlayer, adjacent to the protective antistress layer, satisfying results for water spot defects and pressure sensitivity are obtained without negatively influencing sensitometric characteristics. Whereas from the figures in Table 3 pressure sensitivity is almost independent on the composition of the afterlayer water spot defects are clearly related with the presence the polymer latex in the afterlayer.

Example 4

In Table 4 hereinafter data have been given for materials which have been coated with an afterlayer as described hereinbefore with variable amounts of gelatin ($x_2$) and different types and amounts of polymer latex ($y_2$) and wherein also in the protective layer variable amounts of latex polymer of different types are added. In the protective layer a constant amount of gelatin (x1) has been coated (0.71 g/m²). Differences in the total amounts of the sum of gelatin ($x_1$+$x_2$) and polymer latex ($y_1$+$y_2$) have also been given as well as ratios of polymer latex and gelatin in the afterlayer ($y_2/x_2$). In the protective layer only for material "W" 0.6 g/m² of polymer latex was coated ($y_1$).

Following latex type polymers were used in the different coatings:

W and W': copolymer poly(butyl methacrylate) polyacrylamide N-substituted sulfo-isobutyl sodium salt (see formula I) in a ratio amount of butyl methacrylate and acrylamide N-substituted sulfoisobutyl sodium salt of 95:5;

X: polybutylacrylate latex

Y: polybutylmethacrylate latex

Z: polymethylmethacrylate latex)

Z': polyethylacrylate latex

"Water spot defects" were evaluated in hardener containing processing solutions (G138/G334) after running in a KODAK M6 automatic processor. Glare or gloss was evaluated after manual processing making use therefore from a hardener-free developer and a hardener-free fixer the composition of which has been given hereinafter:

Composition of the hardener-free developer:

concentrated part:

| | |
|---|---|
| water | 200 ml |
| potassium bromide | 12 grams |
| potassium sulphite (65% solution) | 249 grams |
| ethylenediaminetetraacetic acid, sodium salt, trihydrate | 9.6 grams |
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 11 grams |
| potassium iodide | 0.088 grams |
| 4-hydroxymethyl-4-methyl-1phenyl 3-pyrazolidinone | 12 grams |
| Water to make 1 liter | |

pH adjusted to 11.15 at 25° C. with potassium hydroxide.

For initiation of the processing one part of the concentrated developer was mixed with 3 parts of water. No starter was added. The pH of this mixture was 10.30 at 25° C.

Composition of the hardener-free fixer:

concentrated part:

| | |
|---|---|
| ammonium thiosulfate (78% solution) | 661 grams |
| sodium sulphite | 54 grams |
| boric acid | 25 grams |
| sodium acetate-trihydrate | 70 grams |
| acetic acid | 40 grams |
| water to make 1 liter | |

pH adjusted with acetic acid to 5.30 at 25° C.

To make this fixer ready for use one part of this concentrated part was mixed with 4 parts of water. A pH of 5.25 was measured at 25° C.

TABLE 4

| Film | F | S | C | $x_{1+x2}$ + $y_2$ + $y_2$ in g/m$^2$ | $y_2$ g/m$^2$ polymer latex | $x_2$ g/m$^2$ of gelatin | $y_2/x_2$ | WSD (M6) | Gloss |
|---|---|---|---|---|---|---|---|---|---|
| W | 16 | 163 | 2.74 | 1.30 | 0.00 | 0.00 | | 2.5 | 3.0 |
| W' | 16 | 165 | 2.61 | 1.51 | 0.60 | 0.20 | 3.00 | 0.5 | 1.0 |
| X | 22 | 165 | 2.59 | 1.51 | 0.60 | 0.20 | 3.00 | 0.0 | 1.0 |
| Y | 17 | 163 | 2.55 | 1.51 | 0.60 | 0.20 | 3.00 | 0.0 | 1.0 |
| Z | 14 | 163 | 2.70 | 1.51 | 0.60 | 0.20 | 3.00 | 1.5 | 1.0 |
| Z' | 11 | 161 | 2.74 | 1.51 | 0.60 | 0.20 | 3.00 | 1.0 | 2.0 |

As becomes clear from Table 4 the worse results are obtained in the absence of an afterlayer, even when a polymer latex is present in the protective antistress. Once an afterlayer has been coated, the presence of a polymer latex in an excessive amount versus gelatin ($y_2/x_2$=3:1) makes water spot defects disappear after processing in hardener-containing processing solutions and makes glare or gloss become excellent, after processing in hardener-free processing solutions.

Having described in detail preferred embodiments of the current invention, it will now be apparent to those skilled in the art that numerous modifications can be made therein without departing from the scope of the invention as defined in the appending claims.

What is claimed is:

1. A light-sensitive silver halide photographic material comprising a support and on one or both sides thereof at least one light-sensitive silver halide emulsion layer, a gelatinous protective antistress layer and, adjacent thereto as an outermost layer, a gelatinous afterlayer, characterized in that said afterlayer comprises at least one polymer latex, being a polybutylacrylate, a polybutylmethacrylate latex or a copolymer latex being a copolymer poly (butyl methacrylate) polyacrylamide N-substituted sulfo-isobutyl salt, in a ratio amount by weight of (co)polymer latex to gelatin in said afterlayer in a range from 1:1 up to 5:1 and a total amount of (co)polymer latex and gelatin in said afterlayer is of at least 0.1 g/m$^2$ and not exceeding a value of 0.8 g/m$^2$.

2. Material according to claim 1, wherein in the poly (butyl methacrylate) polyacrylamide N-substituted sulfo-isobutyl salt copolymer a ratio amount of butylmethacrylate and acrylamide-N-isobutyl-sulphonic acid sodium salt is at least 80:20.

3. Material according to claim 1, wherein said protective antistress layer is free from any polymer or copolymer latex.

4. Material according to claim 1, wherein said ratio amount by weight of (co)polymer latex to gelatin is up to 3:1.

5. Material according to claim 1, wherein in the protective antistress layer gelatin is present in the range of from 0.20 to 1.0 g per m$^2$ and wherein in the outermost afterlayer gelatin is present in the range of from 0.05 to 0.50 g per m$^2$.

6. Material according to claim 1, wherein in the protective antistress gelatin is present in the range of from 0.20 to 1.0 g per m$^2$ and wherein in the outermost afterlayer gelatin is present in the range of from 0.10 to 0.40 g per m$^2$.

7. Material according to claim 1, wherein amounts of latex (co)polymer(s) are in the range from 0.05–0.60 g/m$^2$.

8. Material according to claim 1, wherein said material is an X-ray material.

* * * * *